US007305780B2

(12) United States Patent
Lukas et al.

(10) Patent No.: US 7,305,780 B2
(45) Date of Patent: Dec. 11, 2007

(54) PRESSING IRON HAVING A SOLEPLATE PROVIDED WITH A PATTERN OF STEAM OUTLET HOLES

(75) Inventors: Andrea Lukas, Offenbach (DE); Matthias Hahn, Frankfurt (DE); Michel Forest, Vienne (FR)

(73) Assignee: Rowenta Werke GmbH, Offenbach (DE)

( * ) Notice: Subject to any disclaimer, the term of this patent is extended or adjusted under 35 U.S.C. 154(b) by 0 days.

(21) Appl. No.: 11/543,820

(22) Filed: Oct. 6, 2006

(65) Prior Publication Data

US 2007/0079534 A1 Apr. 12, 2007

(30) Foreign Application Priority Data

Oct. 6, 2005 (FR) ..... 05 10203

(51) Int. Cl.
*D06F 75/38* (2006.01)
*D06F 75/08* (2006.01)

(52) U.S. Cl. ..... 38/93

(58) Field of Classification Search ..... 38/93, 38/80, 81, 77.83, 77.9, 88, 97
See application file for complete search history.

(56) References Cited

U.S. PATENT DOCUMENTS 3,257,746 A * 6/1966 Cohen ..... 38/97
3,318,029 A * 5/1967 Jacobson ..... 38/97
3,404,471 A * 10/1968 Wilsker et al. ..... 38/97
4,642,922 A 2/1987 Prudenziati et al.
5,664,349 A * 9/1997 White et al. ..... 38/97
5,815,962 A * 10/1998 Emberson-Nash et al. ..... 38/97
5,979,089 A * 11/1999 Bouleau et al. ..... 38/77.83
6,189,245 B1 2/2001 Louison et al.

FOREIGN PATENT DOCUMENTS

| | | |
|---|---|---|
| AU | 716 301 B2 | 2/2000 |
| DE | 26 12 848 B1 | 5/1977 |
| FR | 2 767 542 A | 2/1999 |
| FR | 2 802 555 A | 6/2001 |
| GB | 1 131 821 A | 10/1968 |

* cited by examiner

*Primary Examiner*—Ismael Izaguirre
(74) *Attorney, Agent, or Firm*—Browdy and Neimark, PLLC

(57) ABSTRACT

Pressing iron composed of a soleplate fixed to a heating body, wherein the soleplate has a pattern of at least 200 steam outlet holes each having a passage cross section smaller than 4 $mm^2$, with spacings of less than 10 mm between hole centers, and wherein the pattern of steam outlet holes is interrupted by an imperforate band having a width greater than 10 mm, which band extends over the pattern.

18 Claims, 5 Drawing Sheets

PRESSING IRON HAVING A SOLEPLATE PROVIDED WITH A PATTERN OF STEAM OUTLET HOLES

BACKGROUND OF THE INVENTION

The present invention relates to pressing irons having a soleplate fixed to a heating body and provided with steam outlet holes, and relates more particularly to a steam iron having a soleplate presenting a particular arrangement of the steam outlet, or delivery, holes, or nozzles.

U.S. Pat. No. 4,642,922 discloses a pressing iron having a soleplate and a removable sheet attached to the base of the soleplate. The sheet is furnished with a plurality of steam outlet holes of small diameter distributed uniformly over its surface. The soleplate has a plurality of ribs that come in contact with the sheet, between the steam outlet holes. The ribs act to rigidify the sheet. The spaces between the ribs define steam distribution channels. Such a soleplate with a sheet having a very large number of steam outlet holes presents the advantage of permitting a uniform and homogeneous diffusion of the steam over the fabric being ironed, thus assuring a good impregnation of the fabric with moisture to produce an optimized ironing result.

However, the heating body of such a pressing iron presents the drawback of having a number of pins that are complex and costly to produce. In addition, the steam distribution channels that are disposed between the pins have small cross sections and can be rapidly blocked by mineral deposits.

BRIEF SUMMARY OF THE INVENTION

The present invention provides an improved pressing iron that substantially overcomes the above-described drawbacks.

The iron according to the invention has a soleplate provided with a particular arrangement of steam outlet holes assuring a good distribution of steam toward the fabric as well as a good heat transfer from the heating body toward the soleplate, which soleplate can be associated with a heating body that is simple and economical to produce.

A pressing iron according to the present invention comprises a soleplate fixed to a heating body, wherein the soleplate has a pattern of at least 200 steam outlet holes each having a passage cross section smaller than 4 $mm^2$, the mesh of the pattern, or the spacings between hole centers, having a size less than 10 mm, and wherein the pattern of steam outlet holes is interrupted by a band having a width greater than 10 mm, which band is, imperforate, or free of any holes, and extends over the pattern.

Such a characteristic presents the advantage of permitting a uniform distribution of steam, through the pattern having a high density of steam outlet holes of small diameter, and successive drying of the fabric by the wide band of the soleplate that extends across the pattern and is free of holes. In addition, the presence of the band of solid material, free of steam outlet holes, extending across the pattern, adds to the rigidity of the soleplate and simplifies the attachment of the soleplate to the heating body.

Of course, the pattern of holes could advantageously be divided into several component patterns of holes and the patterns and arrangement of holes in the patterns could have various geometric forms, and could be, for example rectangular or triangular.

According to another characteristic of the invention, the surface area of the band that is free of holes can represent between 10 and 30% of the entire surface area of the soleplate and the surface area occupied by the pattern of steam outlet holes can represent at least 50% of the total surface area of the soleplate.

According to another characteristic of the invention, these steam outlet holes are provided with steam by a distribution chamber extending, on the lower face of the heating body, opposite the pattern of steam outlet holes, the band that is free of holes being in thermal contact with bearing surfaces projecting into the steam distribution chamber.

According to another feature of the invention, the soleplate has a central pattern and a peripheral pattern of steam outlet holes, each hole having a cross-sectional area of less than 4 $mm^2$. The holes are disposed side-by-side with a spacing less than 10 mm. An intermediate zone, or band, that is free of steam outlet holes extends between the central pattern and the peripheral pattern. The intermediate zone surrounds the central pattern and has a width greater than 10 mm.

According to another feature of the invention, the central pattern and the peripheral pattern of steam outlet holes are substantially concentric to one another.

According to still another feature of the invention, the steam distribution chamber has a peripheral chamber substantially coextensive with, and facing, the peripheral pattern and a central chamber substantially coextensive with, and facing, the central pattern and the central chamber communicates with the peripheral chamber through channels extending across the intermediate zone.

According to another feature of the invention, the soleplate is a colaminated soleplate having an exterior skin, or sheet, of stainless steel and an interior skin, or sheet, of aluminum in contact with the heating body. Such a feature offers the advantage of permitting an excellent transfer of heat from the heating body to the soleplate as well as a good scratch resistance of the ironing surface of the soleplate.

According to another feature of the invention, the peripheral pattern has holes of larger diameter in the rear part of the soleplate. This arrangement facilitates possible evacuation of mineral particles that may detach from the steam chamber of the iron, for example pursuant to a self-cleaning procedure.

According to still another characteristic of the invention, the steam outlet holes are produced by punching, or stamping.

According to still another feature of the invention, the steam distribution chamber is supplied with steam through holes opening, on the upper face of the heating body, through at least one chimney, or passage, having a beveled, or chamfered, end.

DETAILED DESCRIPTION OF THE INVENTION

Figure 1:
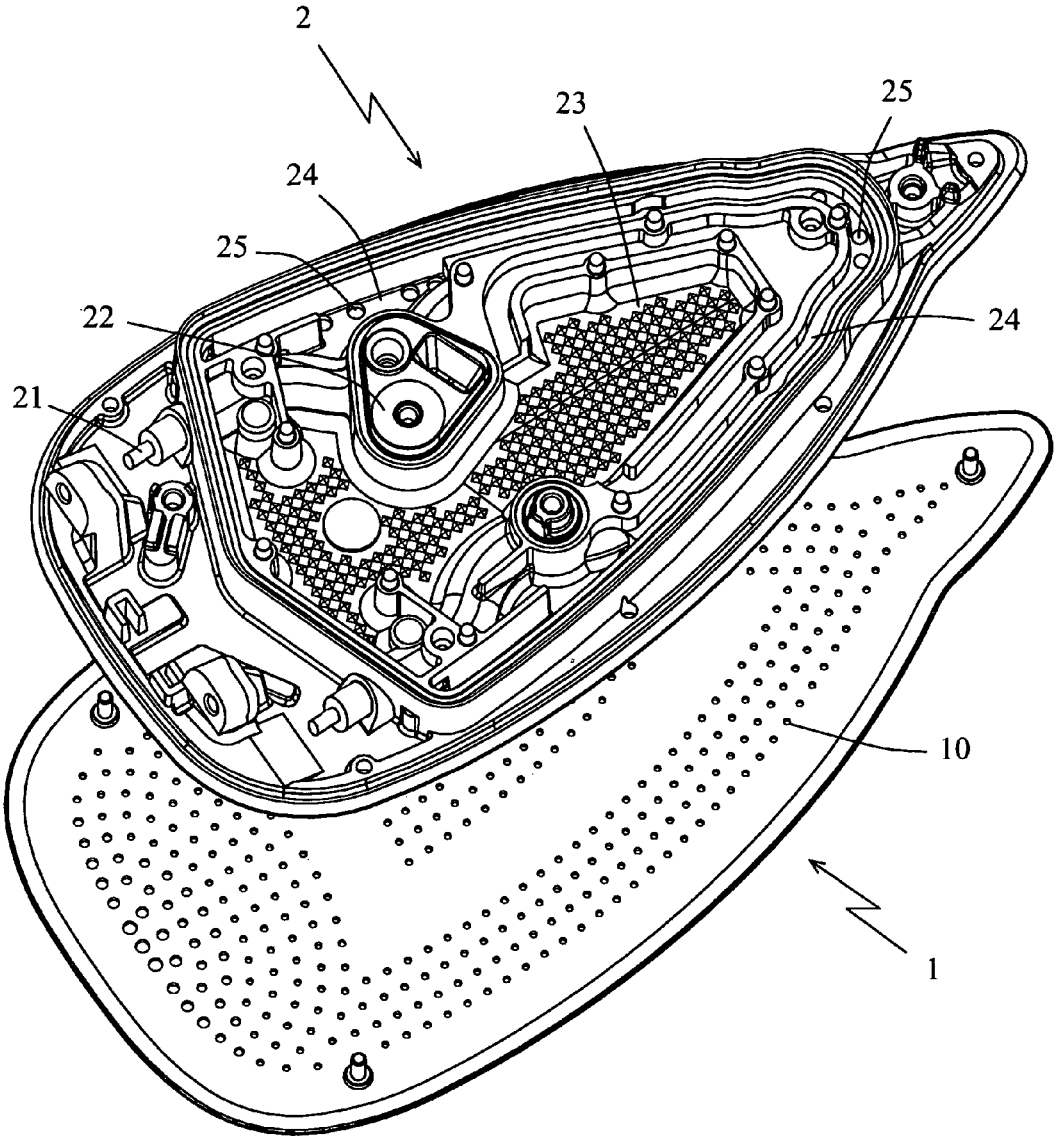
FIG. 1 is an exploded perspective view of a soleplate assembly of an iron according to the invention, viewed from above.

Only the components and features necessary for an understanding of the invention have been shown. To facilitate consideration of the drawings, identical elements have identical reference numerals from one figure to another.

Figure 2:
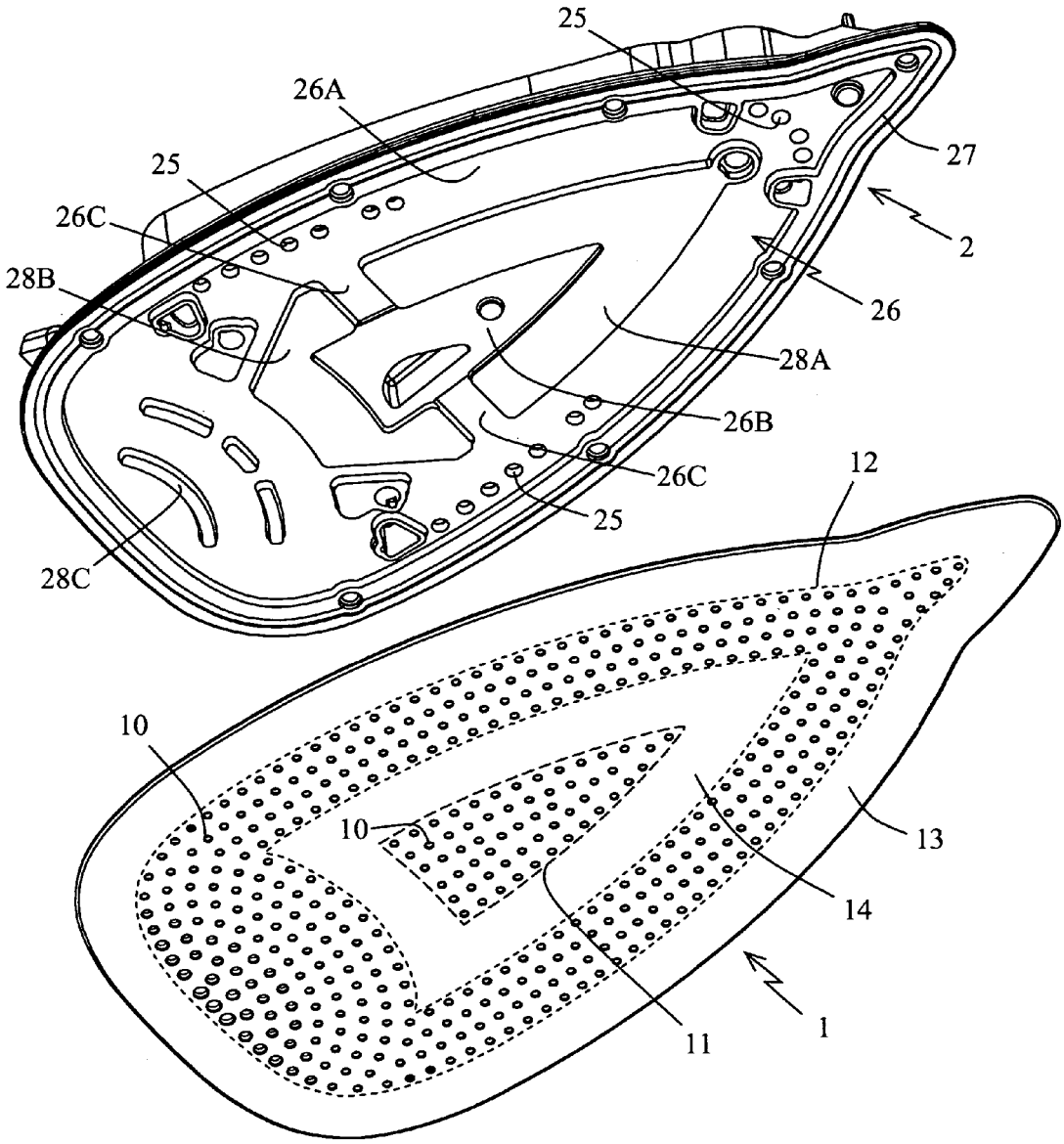
FIG. 2 is an exploded perspective view of the assembly of FIG. 1, viewed from below.
Figure 3:
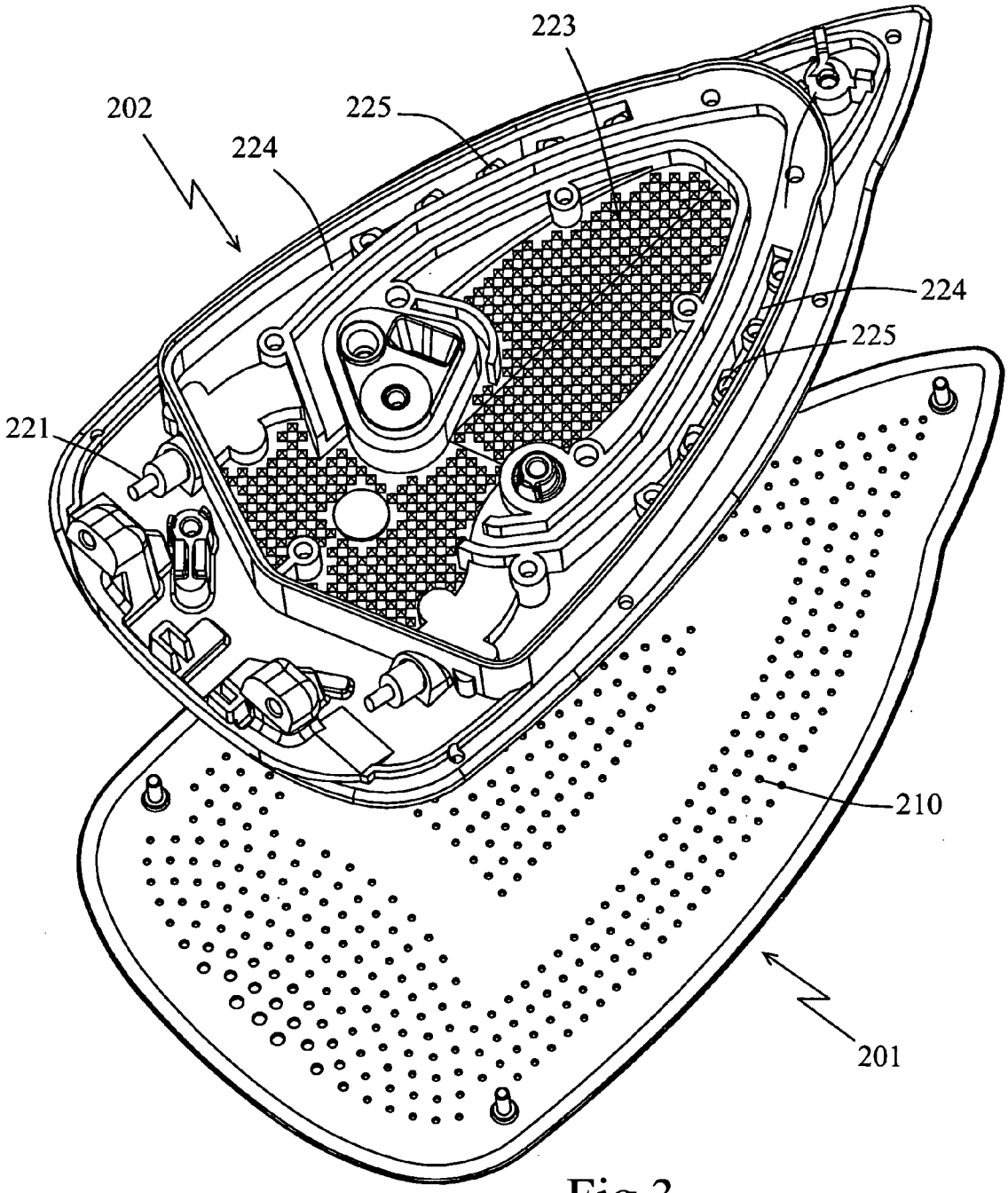
FIG. 3 is an exploded perspective view of a soleplate assembly according to a second embodiment of the iron according to the invention, viewed from above.

According to a first embodiment of the invention, the steam iron includes a soleplate assembly, as shown in FIGS. 1 and 2. This assembly will be mounted in a conventional manner below a water reservoir in a pressing iron and is composed of a soleplate 1 having a distinct front tip and a heating body 2 connected to soleplate 1. Heating body 2 is advantageously made of aluminum and includes, in a conventional manner, a generally U-shaped, or horseshoe shaped, resistance heating element 21, as well as a boss 22 provided to receive a temperature regulation thermostat.

Heating body 2 includes, in its upper part, a steam generating chamber 23 of large dimensions covered, in a conventional manner, by a closing plate (not shown).

Water is conducted from the reservoir, in a manner well-known in the art, through a drip device into steam chamber 23 and the steam generated in chamber 23 is distributed by a U-shaped channel 24 extending over the upper face of heating body 2 and having two branches extending substantially along the edges of the steam chamber.

Channel 24 presents, at the level of the rear half of heating body 2 and in proximity to the front tip of soleplate 1, holes 25 that pass through the heating body and open into a steam distribution chamber 26 extending across the lower face of heating body 2 and feeding steam outlet holes 10 of soleplate 1.

As shown in FIG. 2, these steam outlet holes 10 are distributed across soleplate 1 in a central pattern 11 and a peripheral pattern 12, the boundaries of these patterns being designated by broken lines in FIG. 2. Such broken lines do not appear in practical embodiments of the soleplate.

More particularly according to the invention, holes 10 of each pattern 11, 12 form a mesh in which the holes are disposed side-by-side with a spacing, between hole centers, of less than 10 mm and preferably of the order of 5 mm. Each hole 10 has a cross-sectional area less than 4 $mm^2$ and the holes are obtained, for example, by punching or stamping of soleplate 1 in a manner to give each hole a rounded edge at the lower, ironing, face of soleplate 1. Preferably, holes 10 are circular and have a diameter less than 2 mm and advantageously of the order of 1.5 mm.

In the embodiment of FIGS. 1 and 2, peripheral pattern 12 contains more than 200 steam outlet holes disposed, along each side of soleplate 1, in four rows that extend parallel to the respective edge of the soleplate and that meet at the level of the front tip of soleplate 1 to form a series of holes 10 disposed in a generally triangular pattern at the level of the front tip of soleplate 1. Peripheral pattern 12 also has, at the rear part of the soleplate, a series of steam outlet holes 10 disposed in a plurality of rows having the form of circular arcs. The holes 10 closest to the rear edge of the soleplate and situated close to the longitudinal axis of the soleplate have a larger interior diameter, of the order of 2 to 3 mm, facilitating possible evacuation of mineral deposit particles.

The central pattern 11 has more than fifty steam outlet holes 10 disposed in a substantially triangular mesh concentric with peripheral pattern 12.

In an advantageous manner, soleplate 1 has an outer band of material 13 having a width of the order 15 mm, free of any holes and surrounding peripheral pattern 12. Soleplate 1 also has an intermediate band of material 14, free of any holes, having a width of the order of 15 to 20 mm and extending between central pattern 11 and peripheral pattern 12.

Preferably, the surface area of band 14 represents between 10 and 30% of the total surface area of the soleplate and the surface area occupied by central and peripheral patterns 11 and 12 represents more than 50% of the total surface area of soleplate 1.

Outer and intermediate bands 13 and 14 also come in thermal contact with heating body 2 and assure transfer of heat from heating body 2 to soleplate 1.

A sealing joint is disposed between heating body 2 and exterior band 13, in a groove 27, to assure sealing of steam distribution chamber 26.

As can be seen in FIG. 2, steam distribution chamber 26 has a peripheral chamber 26A comprising arms, with a depth of the order of 2 mm and a width greater than 15 mm, extending opposite peripheral pattern 12.

In order to rigidify soleplate 1 and to have a good transfer of heat between heating body 2 and soleplate 1, heating body 2 has bearing surfaces protruding at the middle of steam distribution chamber 26 and to which intermediate band 14 of the soleplate is bonded or cemented. These bearing surfaces are essentially constituted by a surface 28A in the form of a V and a surface 28B in the form of a U, surfaces 28A and 28B being arranged head to tail. Surfaces 28A and 28B present arms having a width greater than 10 mm delimiting a central chamber 26B having a substantially triangular form and a depth of the order of 1.2 mm, facing central hole pattern 11. Central chamber 26B is supplied with steam through two channels 26C, each having a width of the order of 10 mm, interposed between bearing surfaces 28A, 28B and extending transversely to the longitudinal direction of the iron.

Heating body 2 also has pins, or protuberances, 28C that come in contact with soleplate 1 between holes 10 of peripheral pattern 12 located at the rear part of the soleplate, these pins 28C rigidifying the soleplate and participating in the transfer of heat toward the soleplate.

In a preferred manner, and in order to improve heat transfer from heating body 2 toward soleplate 1, while assuring that the soleplate has a good resistance to scratching, soleplate 1 is colaminated and includes a lower skin, or sheet, with a thickness of the order 0.2 mm and made up stainless steel to serve as the ironing surface and an upper skin, or sheet, having a thickness of the order of 1.3 mm, made of aluminum and arranged to be in contact with the heating body.

The pressing iron thus obtained has a soleplate provided with a large number of perforations, or holes, each of a small diameter, presenting the advantage of permitting a more homogeneous impregnation of the fabric being ironed with steam, which facilitates the ironing operation. In addition, the presence of an intermediate zone free of steam outlet holes permits the fabric to be dried by transmitting heat from the heating body, facilitates the attachment of the soleplate to the heating body, notably by bonding or cementing, and assures a good rigidity of the soleplate. Thus results in a soleplate having an optimized ironing effectiveness. Finally, the presence of larger diameter holes at the rear of the iron facilitates the evacuation of mineral deposit particles, particularly after a self-cleaning operation of the iron by injection of a large quantity of water into the steam chamber at high temperature. The channels of the steam distribution chamber present the advantage of having a large width and thus of not being easily obstructed by mineral deposits.

According to another embodiment of the invention, the pressing iron is associated with a separate steam generator and includes the soleplate assembly shown in FIGS. 3 to 6. This soleplate assembly includes a soleplate 201 and a heating body 202 comprising a heating element 221 and presenting, in its upper part, a heating chamber 223 into which steam under pressure issuing from the boiler of the separate steam generator is injected in order to vaporize possible water droplets present in the steam.

Steam from heating chamber 223 is distributed by channels 224 extending along each side of heating body 202, while following substantially the curve of the edge of soleplate 201. These channels 224 include holes 225 passing through heating body 202 and opening into a distribution chamber 226 supplying steam to steam outlet holes 210 of soleplate 201.

These steam outlet holes 210 are distributed in a central pattern 211 and a peripheral pattern 212 separated by an intermediate band 214 of material, which is free of holes and is bonded or cemented onto bearing surfaces 228A, 228B projecting from the middle of distribution chamber 226. Central pattern 211 and peripheral pattern 212 as well as distribution chamber 226 have structural and functional characteristics similar to those described with respect to the embodiment shown in FIGS. 1 and 2.

According to this second embodiment, in which the soleplate assembly is adapted to be used in an iron having a separate steam generator, each of holes 225 passing through the heating body has the particularity of being surmounted by a chimney, or stack, 229 that projects upwardly into a channel 224 and the upper end of which is chamfered, or slanted, so that the upper face 229A of each stack is inclined with respect to the axis of the associated hole 225.

Figure 4:
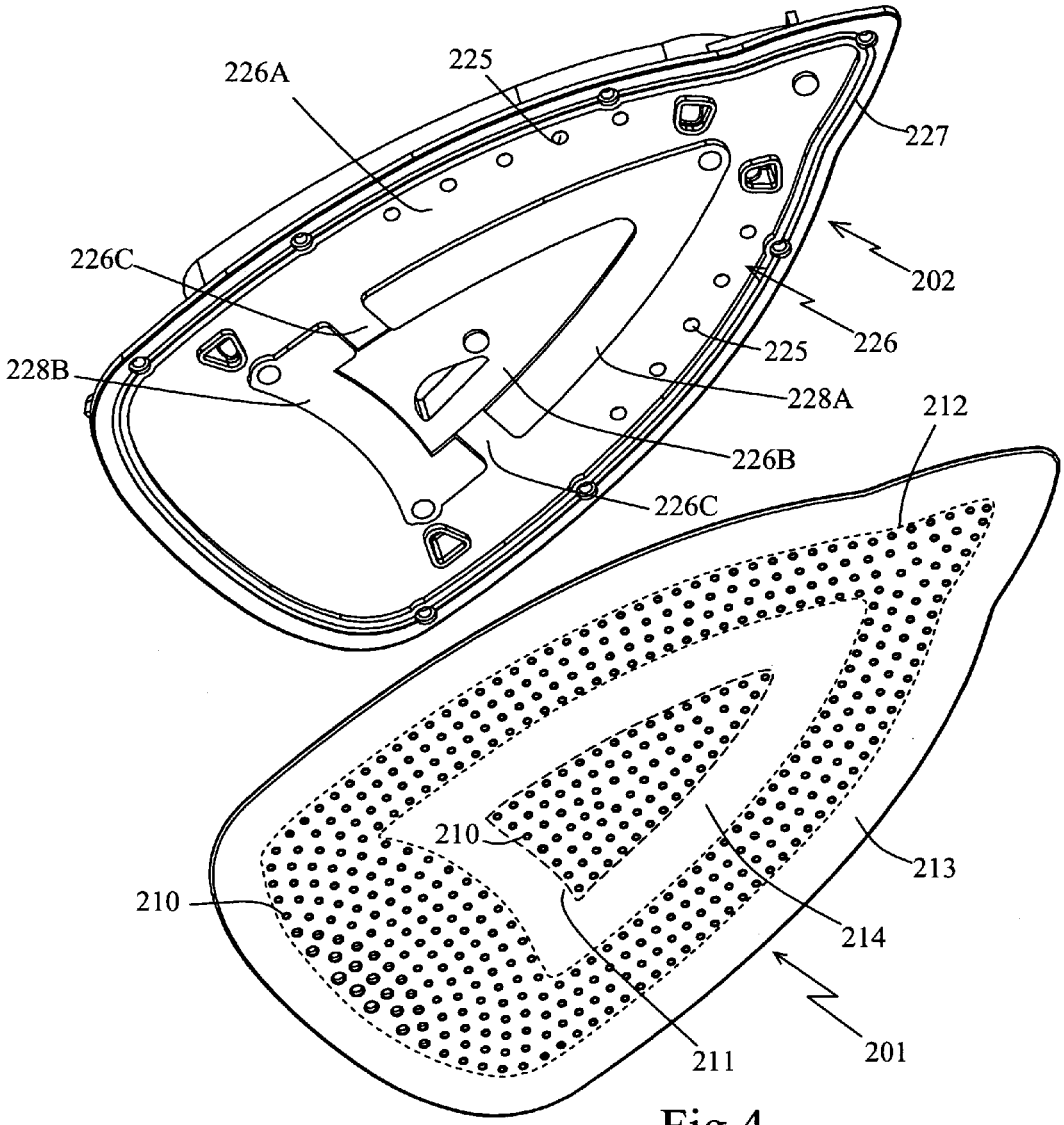
FIG. 4 is an exploded perspective view of the assembly of FIG. 3, viewed from below.
Figure 5:
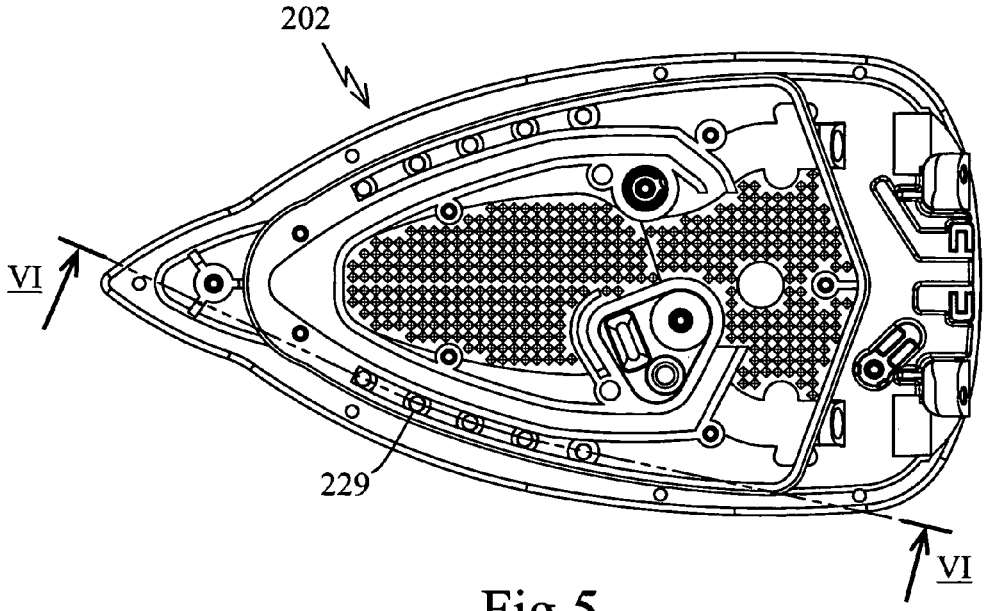
FIG. 5 is a top plan view of one component of the assembly of FIG. 3.
Figure 6:
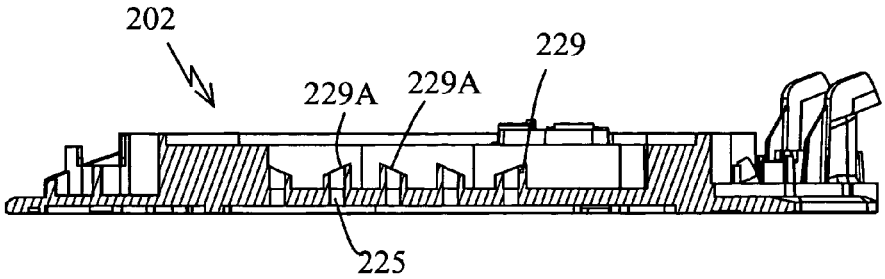
FIG. 6 is a cross-sectional view taken along line VI-VI of FIG. 5.

As shown in FIGS. 4 to 6, the orientation of the upper faces 229A differs from one hole 225 to another and permits the creation of turbulence that improves the distribution of steam among the various holes 225, when steam under pressure is delivered into heating chamber 223, so that there is obtained a more uniform distribution of steam over all of the holes 210 of the soleplate.

Of course, the invention is not in any way limited to the embodiments described and illustrated herein, which have been given only by way of example. Modifications remain possible, notably from the point of view of the construction of the various elements or by substitution of technical equivalents, without departing from the framework of the invention.

Thus, according to one variant, the form and number of rows of holes in the central pattern and in the peripheral pattern can be different from those described herein. The steam outlet holes could have an oblong form rather than circular. According to other variations, the band of material that is free of holes could extend transversely across a pattern of holes or could extend only partially across the pattern.

This application relates to subject matter disclosed in French Patent Application No. 05 10203, filed on Oct. 6, 2005, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. Pressing iron comprising: a soleplate fixed to a heating body, wherein said soleplate has a pattern of at least 200 steam outlet holes each having a passage cross section smaller than 4 $mm^2$, with spacings of less than 10 mm between hole centers, said pattern of steam outlet holes being interrupted by an imperforate band having a width greater than 10 mm, which band extends over said pattern; and a steam distribution chamber for supplying steam to said steam outlet holes, said steam distribution chamber extending, on the lower face of the heating body, opposite said pattern of steam outlet holes, and wherein said band that is free of holes is in thermal contct with bearing surfaces provided on the heating body and projecting into the steam distribution chamber.

2. The pressing iron of claim 1, wherein the surface area of said band that is free of holes is between 10 and 30% of the entire surface area of said soleplate and the surface area occupied by said pattern of steam outlet holes is at least 50% of the total surface area of said soleplate.

3. The pressing iron of claim 2, wherein said steam distribution chamber is supplied with steam through holes opening, on the upper face of the heating body, through at least one chimney, or passage, having a beveled, or chamfered, end.

4. Pressing iron comprising:

a soleplate fixed to a heating body, wherein said soleplate has a pattern of at least 200 steam outlet holes each having a passage cross section smaller than 4 $mm^2$, with spacings less than 10 mm between hole centers, said pattern of steam outlet holes being interrupted by an imperforate band having a width greater than 10 mm, which band extends over said pattern, wherein the surface area of said band that is free of holes is between 10 and 30% of the entire surface area of said soleplate and the surface area occupied by said pattern of steam outlet holes is at least 50% of the total surface area of said soleplate; and a steam distribution chamber for supplying steam to said steam outlet holes, said steam distribution chamber extending, on the lower face of the heating body, opposite said pattern of steam outlet holes, and wherein said band that is free of holes is in thermal contact with bearing surfaces provided on the heating body and projecting into the steam distribution chamber, wherein said pattern is composed of a central pattern portion and a peripheral pattern portion of steam outlet holes, each of said holes having a cross-sectional area of less than 4 $mm^2$, said holes in each said pattern portion being disposed side-by-side with a spacing of less than 10 mm between hole centers, and said soleplate further has an intermediate zone, or band, that is free of steam outlet holes, extends between the central pattern and the peripheral pattern, surrounds the central pattern and has a width greater than 10 mm in a direction between said central pattern portion and said peripheral pattern portion.

5. The pressing iron of claim 4, wherein said central pattern portion and said peripheral pattern portion are substantially concentric to one another.

6. The pressing iron of claim 5, wherein said steam distribution chamber has a peripheral chamber part substantially coextensive with, and facing, said peripheral pattern portion, and a central chamber part substantially coextensive with, and facing, said central pattern portion, and said central chamber part communicates with said peripheral chamber through channels extending across said intermediate zone.

7. The pressing iron of claim 6, wherein said soleplate is a colaminated soleplate having an exterior skin, or sheet, of stainless steel and an interior skin, or sheet, of aluminum in contact with the heating body.

8. The pressing iron of claim 7, wherein, said peripheral pattern has one group of holes at the rear part of said soleplate that are of larger diameter than other holes of said peripheral pattern.

9. The pressing iron of claim 8, wherein said steam outlet holes are produced by punching, or stamping.

10. The pressing iron of claim 9, wherein said steam distribution chamber is supplied with steam through holes opening, on the upper face of the heating body, through at least one chimney, or passage, having a beveled, or chamfered, end.

11. The pressing iron of claim 1, wherein said steam distribution chamber is supplied with steam throuqh holes opening, on the upper face of the heating body, through at least one chimney, or passage, having a beveled, or chamfered, end.

12. Pressing iron comprising: a soleplate fixed to a heating body, wherein said soleplate has a pattern of at least 200 steam outlet holes each having a passage cross section smaller than 4 $mm^2$, with spacings of less than 10 mm betxeen hole centers, said pattern of steam outlet holes being interrupted by an imperforate band having a width greater than 10 mm, which band extends over said pattern, wherein said pattern is composed of a central pattern portion and a peripheral pattern portion of steam outlet holes, each of said holes having a cross-sectional area of less than 4 $mm^2$, said holes in each said pattern portion being disposed side-by-side with a spacing of less than 10 mm between hole centers, and said soleplate further has an intermediate zone, or band, that is free of steam outlet holes, extends between the central pattern and the peripheral pattern, surrounds the central pattern and has a width greater than 10 mm in a direction between said central pattern portion and said peripheral pattern portion.

13. The pressing iron of claim 12, wherein said central pattern portion and said peripheral pattern portion are substantially concentric to one another.

14. The pressing iron of claim 13, wherein said steam distribution chamber has a peripheral chamber part substantially coextensive with, and facing, said peripheral pattern portion, and a central chamber part substantially coextensive with, and facing, said central pattern portion, and said central chamber part communicates with said peripheral chamber through channels extending across said intermediate zone.

15. The pressing iron of claim 12, wherein, said peripheral pattern has one group of holes at the rear part of said soleplate that are of larger diameter than other holes of said peripheral pattern.

16. The pressing iron of claim 1, wherein said soleplate is a colaminated soleplate having an exterior skin, or sheet, of stainless steel and an interior skin, or sheet, of aluminum in contact with the heating body.

17. The pressing iron of claim 1, wherein said steam outlet holes are produced by punching, or stamping.

18. The pressing iron of claim 1, wherein said steam distribution chamber supplies steam to all of said steam distribution holes in said soleplate.

* * * * *